US010158182B2

(12) United States Patent
Iwanaka

(10) Patent No.: US 10,158,182 B2
(45) Date of Patent: Dec. 18, 2018

(54) ELECTRIC FIELD DIRECTION CONVERSION STRUCTURE AND PLANAR ANTENNA

(71) Applicant: NEC Corporation, Tokyo (JP)

(72) Inventor: Daisuke Iwanaka, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 15/501,316

(22) PCT Filed: Mar. 13, 2015

(86) PCT No.: PCT/JP2015/001400
§ 371 (c)(1),
(2) Date: Feb. 2, 2017

(87) PCT Pub. No.: WO2016/027387
PCT Pub. Date: Feb. 25, 2016

(65) Prior Publication Data

US 2017/0244175 A1 Aug. 24, 2017

(30) Foreign Application Priority Data

Aug. 18, 2014 (JP) ..... 2014-166007

(51) Int. Cl.
*H01Q 21/24* (2006.01)
*H01P 5/12* (2006.01)
(Continued)

(52) U.S. Cl.
CPC ..... *H01Q 21/24* (2013.01); *H01P 5/12* (2013.01); *H01P 5/19* (2013.01); *H01P 5/20* (2013.01);
(Continued)

(58) Field of Classification Search
CPC ..... H01Q 21/24; H01Q 5/12; H01Q 15/246; H01Q 21/0006
(Continued)

(56) References Cited

U.S. PATENT DOCUMENTS 5,461,394 A * 10/1995 Weber ..... H01Q 13/0258 343/776
6,879,298 B1 * 4/2005 Zarro ..... H01Q 13/025 343/756
(Continued)

FOREIGN PATENT DOCUMENTS

EP 1930982 A1 6/2008
FR 2582865 A1 12/1986
(Continued)

OTHER PUBLICATIONS

Extended European Search Report issued by the European Patent Office for European Application No. 15833270.0 dated Jul. 27, 2017 (9 pages).
(Continued)

*Primary Examiner* — Huedung Mancuso
(74) *Attorney, Agent, or Firm* — Wilmer Cutler Pickering Hale and Dorr LLP

(57) ABSTRACT

A first waveguide guides a first radio wave whose electric field is vibrated in a first direction along a second direction. A second waveguide guides the first radio wave along the second direction and is cascade connected to the first waveguide. An input and output end multiplexes the first radio waves from the first and second waveguides and outputs the multiplexed radio wave, and outputs the first radio wave branched off from a radio wave from outside to the first and second waveguides. A first waveguide shift portion is shifted from the first waveguide in the first direction. A second waveguide shift portion is shifted from the second waveguide in the first direction. The vibration directions of electric fields of radio waves passing through the end parts of the first and second waveguide shift portions are rotated by 90° about a third direction.

9 Claims, 11 Drawing Sheets

(51) Int. Cl.

| | |
|---|---|
| ***H01P 5/19*** | (2006.01) |
| ***H01P 5/20*** | (2006.01) |
| ***H01Q 15/24*** | (2006.01) |
| ***H01Q 21/00*** | (2006.01) |

(52) U.S. Cl.
CPC ..... *H01Q 15/246* (2013.01); *H01Q 21/0006* (2013.01)

(58) Field of Classification Search
USPC ..... 343/756
See application file for complete search history.

(56) References Cited

U.S. PATENT DOCUMENTS 7,057,571 B2 * 6/2006 Courtney ..... H01Q 13/00 343/772
8,077,103 B1 * 12/2011 Acosta ..... H01Q 1/288 333/21 A
9,774,097 B2 * 9/2017 Clymer ..... H01Q 21/064

FOREIGN PATENT DOCUMENTS

| | | | |
|---|---|---|---|
| JP | H02-312302 | A | 12/1990 |
| JP | H09-246801 | A | 9/1997 |
| JP | 2003-069337 | A | 3/2003 |
| JP | 2008-148149 | A | 6/2008 |
| JP | 2008-283352 | A | 11/2008 |
| JP | 2014-132729 | A | 7/2014 |
| WO | WO-2012/003506 | A2 | 1/2012 |

OTHER PUBLICATIONS

International Search Report corresponding to PCT/JP2015/001400 dated Jun. 9, 2015 (one page).

* cited by examiner

ELECTRIC FIELD DIRECTION CONVERSION STRUCTURE AND PLANAR ANTENNA

CROSS-REFERENCE TO RELATED APPLICATIONS

This application is a national stage application of International Application No. PCT/JP2015/001400 entitled "Electric Field Direction Conversion Structure and Planar Antenna" filed on Mar. 13, 2015, which claims priority to Japanese Application No. 2014-166007 filed on Aug. 18, 2014, the disclosures of which are hereby incorporated by reference in their entirety.

TECHNICAL FIELD

The present invention relates to an electric field direction conversion structure and a planar antenna.

BACKGROUND ART

In recent years, in accordance with an increase in communication traffic, there has been a demand to increase the communication capacity in communication systems such as point-to-point. To meet this demand, it is known to use a communication system that uses a polarized wave shared antenna capable of transmitting or receiving a polarization multiplexed signal including two polarization wave signals having polarization planes perpendicular to each other in order to perform communication by the polarization multiplexed signal. According to this communication system, information can be carried on each of the polarization wave signals, whereby it is possible to double the communication capacity compared to the case in which the polarization multiplexed signal is not used.

A method of transmitting or receiving polarization multiplexed signals by a parabola antenna is already known. Since the parabola antenna has a relatively large thickness and affects wind loads or landscapes, however, a planar antenna has been introduced.

As an example of a polarized wave shared planar antenna, a planar antenna having a structure in which conductors, which are antenna elements, are connected by microstriplines (power feed lines) is disclosed (Patent Literature 1).

A polarized wave shared square opening antenna capable of efficiently separating or combining a vertical polarization wave and a horizontal polarization wave when receiving a polarization multiplexed signal by a square opening or transmitting a polarization multiplexed signal from the square opening is disclosed (Patent Literature 2).

Another antenna apparatus capable of attenuating, when a transmission is performed using rectangular waveguides through which higher-order modes can be propagated, the higher-order modes that can be propagated is disclosed (Patent Literature 3).

CITATION LIST

Patent Literature

[Patent Literature 1] Japanese Unexamined Patent Application Publication No. 2008-283352

[Patent Literature 2] Japanese Unexamined Patent Application Publication No. 2003-69337

[Patent Literature 3] Japanese Unexamined Patent Application Publication No. 2008-148149

SUMMARY OF INVENTION

Technical Problem

However, the present inventors have found the following problems in the aforementioned methods. The planar antenna formed of the microstriplines (e.g., Patent Literature 1) is not suitable for high-frequency communication since it suffers a substantial loss in a high-frequency region, which causes a reduction in the antenna gain. In order to suppress the loss in the high-frequency region, it is desired to guide vertical polarization waves and horizontal polarization waves included in the polarization multiplexed signal to be transmitted or received by waveguides.

When a waveguide path in the planar antenna is formed using the waveguides, the arrangement of the waveguides is restricted compared to the case in which microstriplines are used. Therefore, the thickness of the planar antenna that uses the waveguides increases. On the other hand, while the aforementioned polarized wave shared square opening antenna (Patent Literature 2) and the antenna apparatus (Patent Literature 3) can be used for the planar antenna that uses the waveguides, they do not contribute to suppression of the thickness of the planar antenna.

The present invention has been made in view of the aforementioned circumstances and aims to provide a low-loss and thin polarized wave shared planar antenna.

Solution to Problem

An electric field direction conversion structure according to an exemplary aspect of the present invention includes: a first waveguide that guides a first radio wave whose electric field is vibrated in a first direction along a second direction that is vertical to the first direction between a first end part and a second end part; a second waveguide that guides the first radio wave along the second direction between a third end part and a fourth end part, the second waveguide being cascade connected to the first waveguide by a connection of the first end part and the third end part; an input and output end that multiplexes the first radio wave from the first waveguide and the first radio wave from the second waveguide and outputs the multiplexed radio wave, and outputs the first radio wave branched off from a radio wave from outside to the first and second waveguides at a connection portion between the first end part and the third end part; a first waveguide shift portion having a fifth end part connected to the second end part of the first waveguide and a sixth end part that is shifted from the fifth end part in the first direction, a second radio wave having an electric field vibrated in the second direction being input or output to or from the sixth end part along the second direction; and a second waveguide shift portion having a seventh end part connected to the fourth end part of the second waveguide and an eighth end part that is shifted from the seventh end part in the first direction and in a direction opposite to the sixth end part, the second radio wave having an electric field vibrated in the second direction being input or output to or from the eighth end part along the second direction, in which: the vibration direction of an electric field of a radio wave passing through the sixth end part of the first waveguide shift portion is rotated by 90° about a third direction that is vertical to the first and second directions, and the vibration direction of an electric field of a radio wave passing through the eighth end part of the second waveguide shift portion is rotated by 90° about the third direction in a direction the same as the rotational direction in the sixth end part.

A planar antenna according to an exemplary aspect of the present invention includes a plurality of antenna elements arranged on a first plane, a first waveguide part that receives or outputs a first radio wave from or to the plurality of antenna elements, the first radio wave being received or output by orthogonal polarization transmission, and a second waveguide part that receives or outputs a second radio wave whose polarization plane is perpendicular to the polarization plane of the first radio wave from or to the plurality of antenna elements, in which the first waveguide part and the second waveguide part are laminated to each other substantially parallel to the first plane.

Advantageous Effects of Invention

According to the present invention, it is possible to provide a low-loss and thin polarized wave shared planar antenna.

DESCRIPTION OF EMBODIMENTS

Figure 1:
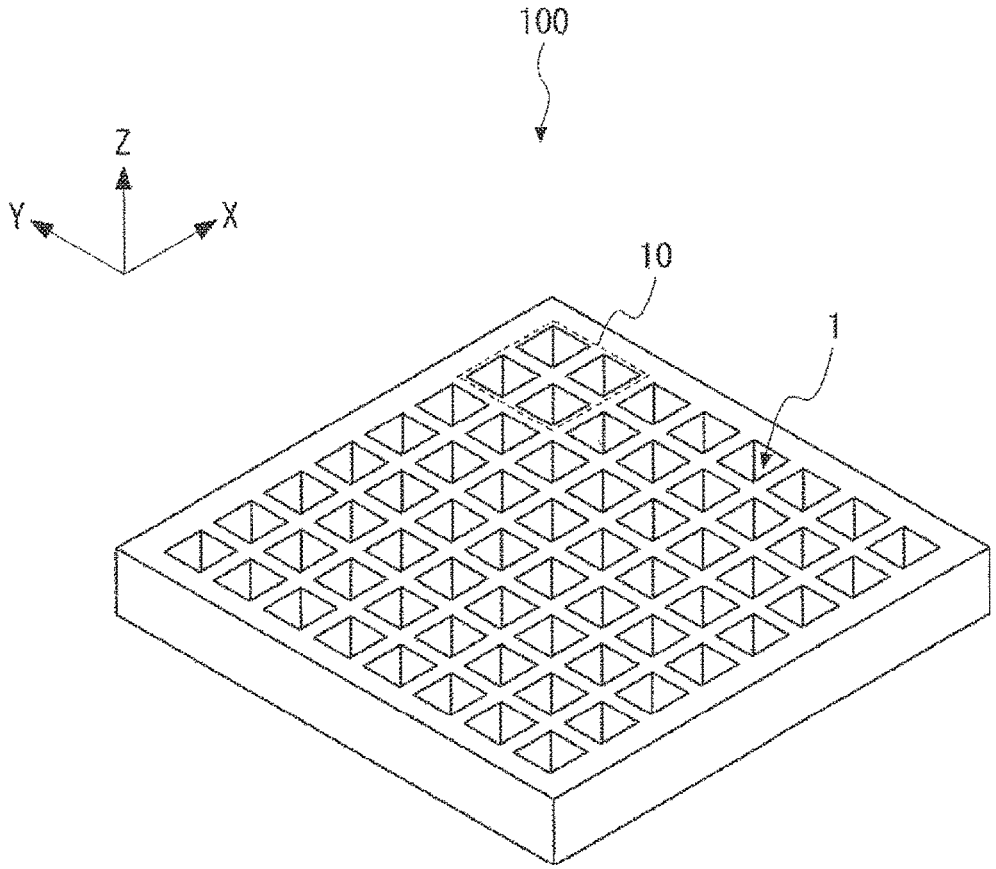
FIG. 1 is a perspective view showing the exterior of a planar antenna 100 according to a first exemplary embodiment.

Exemplary embodiments of the present invention will be described below with reference to the drawings. In the drawings, the same elements are denoted by the same reference symbols, and thus a repeated description is omitted as needed.

First Exemplary Embodiment

A planar antenna 100 according to a first exemplary embodiment will be described. The planar antenna 100 receives a signal obtained by combining two polarization waves, separates the received signal into a vertical polarization wave (hereinafter this wave will also be referred to as a second radio wave) and a horizontal polarization wave (hereinafter this wave will also be referred to as a third radio wave), and outputs the vertical polarization wave and the horizontal polarization wave, or combines a vertical polarization wave and a horizontal polarization wave that have been input and sends the combined signal to outside. In the following description, the polarization wave is also referred to as a radio wave having an electric field that is vibrated in one direction.

FIG. 1 is a perspective view showing the exterior of the planar antenna 100 according to the first exemplary embodiment. The planar antenna 100 includes antennas 10, each of the antennas 10 including four antenna cells 1, arranged in an array. In FIG. 1, the planar antenna 100 is a planar antenna, a principal plane of which is an X-Y plane, and includes antennas 10, each of the antennas 10 including four antenna cells 1 arranged in a grid on the X-Y plane. The antennas 10 each include 2×2=4 antenna cells 1 arranged in the grid. That is, the planar antenna 100 includes the integrated antennas 10, which are small planar antennas.

In this example, the planar antenna 100 includes four antennas 10 in an X direction (the X direction is also referred to as a third direction) and four antennas 10 in a Y direction (the Y direction is also referred to as a second direction), that is, 4×4=16 antennas 10 in total. Therefore, the planar antenna 100 includes eight antenna cells 1 in the X direction and eight antenna cells 1 in the Y direction, that is, 8×8=64 antenna cells 1 in total.

While not shown in FIG. 1, the antenna cells 1 each include a horn antenna portion that transmits and receives a polarization multiplexed signal and a polarization wave separation/combination portion that combines or separates a vertical polarization wave and a horizontal polarization wave. Further, the antenna cells 1 each include a waveguide portion that connects the antenna cells to guide the vertical polarization wave and the horizontal polarization wave. The antenna cell 1, the polarization wave separation/combination portion, and the waveguide portion are each formed of a hollow tube structure in a conductive material such as metal.

In this exemplary embodiment, the polarization wave having an electric field that is vibrated in the Y direction is referred to as the vertical polarization wave and the polarization wave having an electric field that is vibrated in the X direction is referred to as the horizontal polarization wave.

Figure 2:
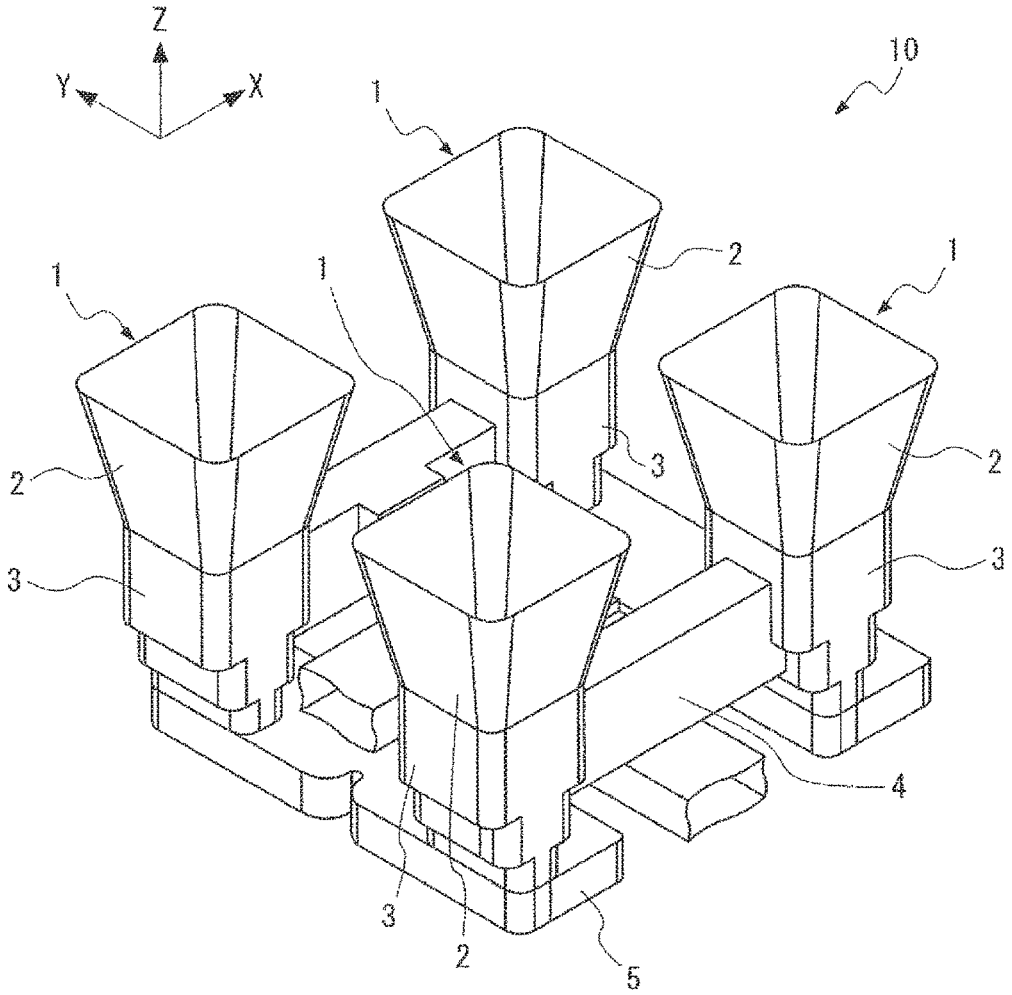
FIG. 2 is a perspective, see-through view schematically showing a configuration of an antenna 10 according to the first exemplary embodiment.
Figure 3:
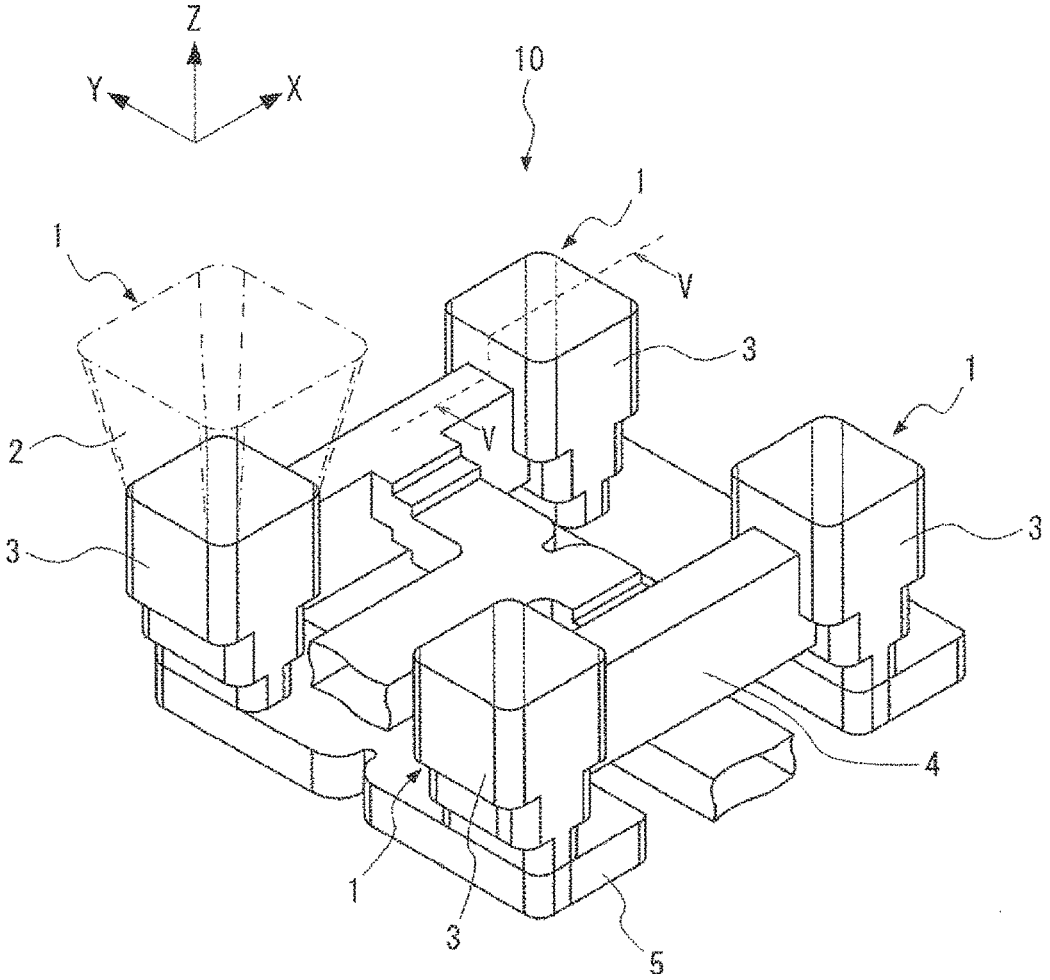
FIG. 3 is a perspective, see-through view showing a structure of the antenna in which a horn antenna portion of the antenna according to the first exemplary embodiment is shown in a transparent manner.

Next, the structure of the antenna cell 1 will be described. FIG. 2 is a perspective, see-through view schematically showing the structure of the antenna 10 according to the first exemplary embodiment. FIG. 2 shows only tube walls of the tube structure which is viewed through the conductive material that covers the aforementioned tube structure to explain the structures of the polarization wave separation/combination portion and the waveguide portion connected to the antenna cell 1. FIG. 3 is a perspective, see-through view showing the structure of the antenna 10 in which the horn antenna portion 2 of the antenna 10 shown in FIG. 2 is shown in a transparent manner.

As shown in FIG. 2, the antenna 10 includes 2×2=4 antenna cells 1 arranged in the grid. The antenna cells 1 each include the horn antenna portion 2 and a polarization wave separation/combination portion 3.

The antenna cell 1 transmits the polarization multiplexed signal to outside or receives the polarization multiplexed signal from outside via the horn antenna portion 2. In this exemplary embodiment, the polarization multiplexed signal transmitted or received by the antenna cell 1 includes the vertical polarization wave and the horizontal polarization wave.

The polarization wave separation/combination portion 3 has a function of separating the polarization multiplexed signal into the vertical polarization wave and the horizontal polarization wave or combining the vertical polarization wave and the horizontal polarization wave into the polarization multiplexed signal.

Figure 4:
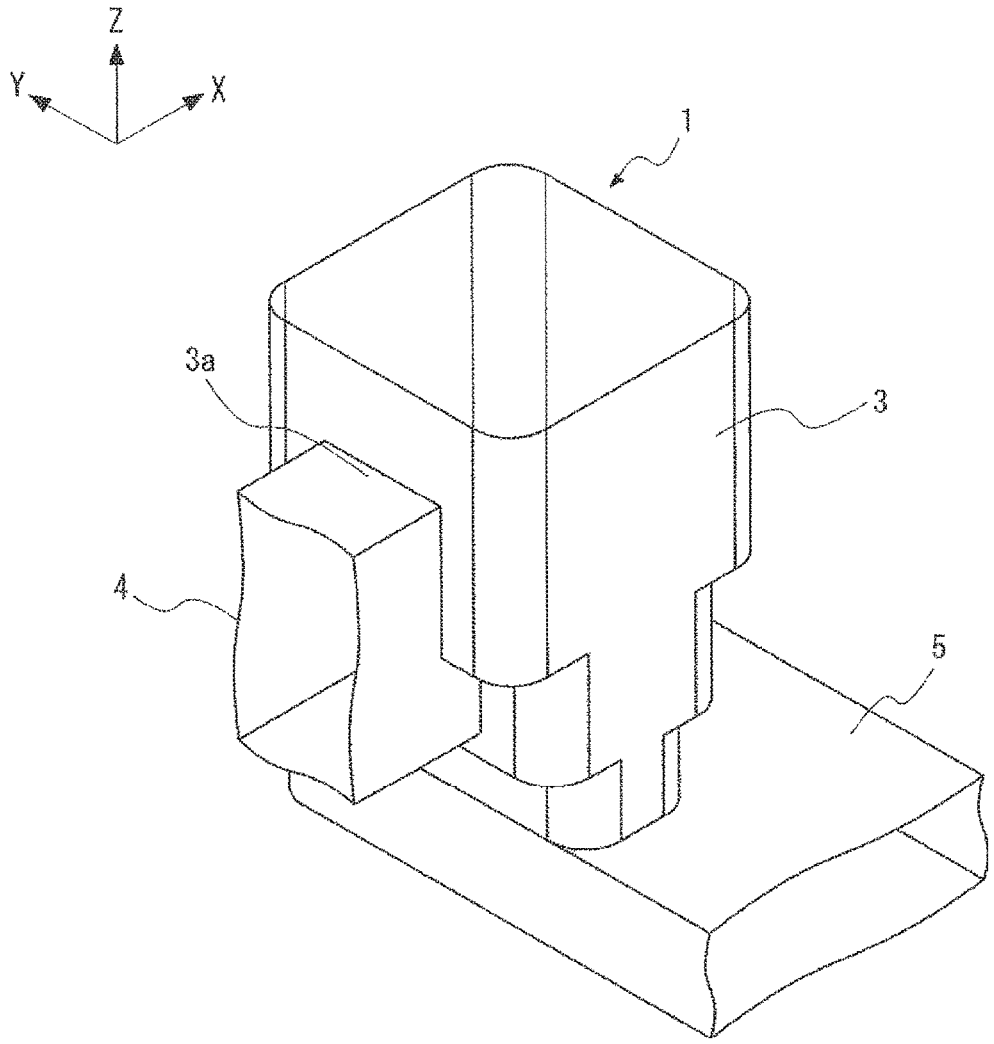
FIG. 4 is a perspective, see-through view showing a configuration of an antenna cell 1 taken along the line V-V of FIG. 3.
Figure 5:
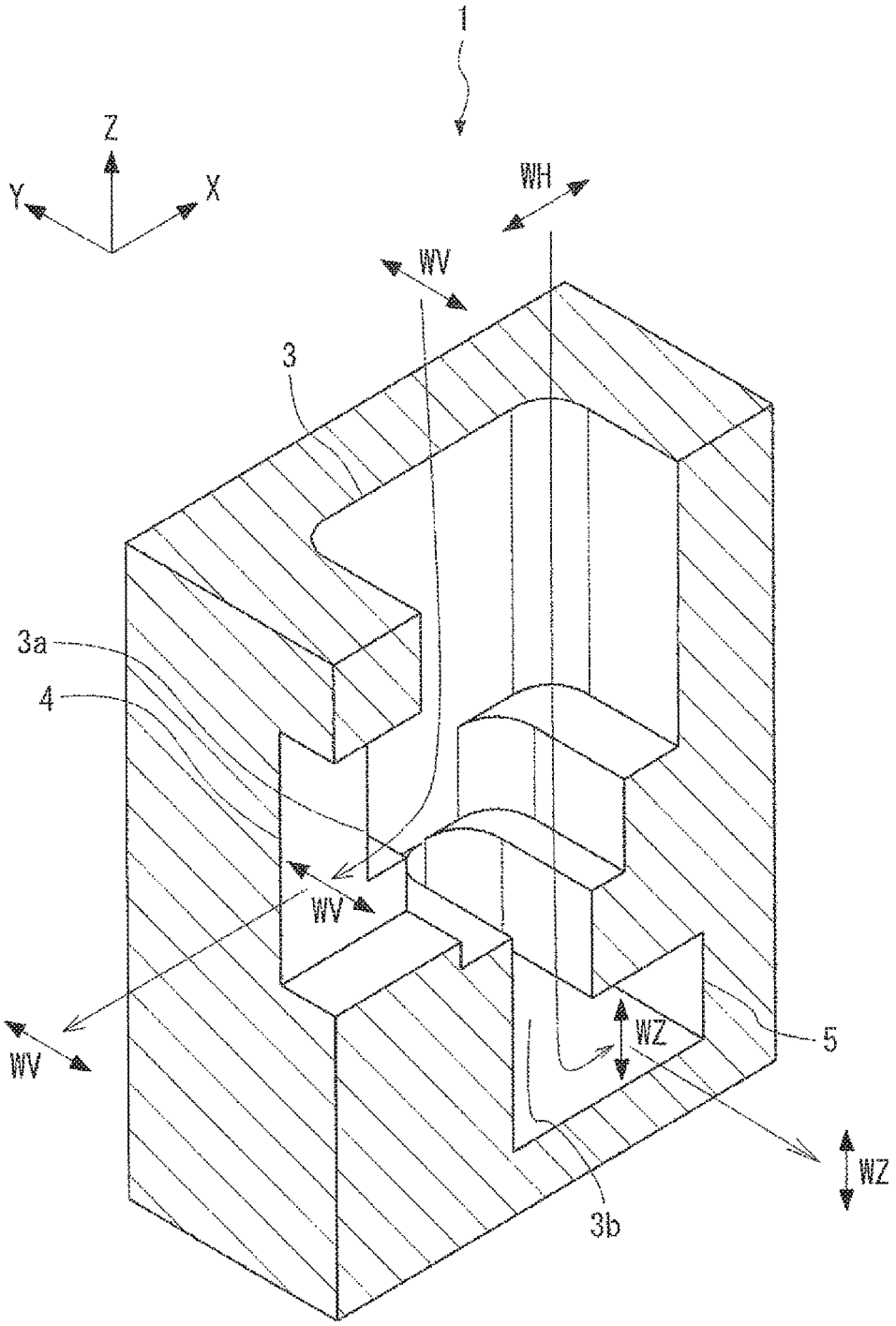
FIG. 5 is a perspective cross-sectional view of the antenna cell 1 taken along the line V-V of FIG. 3.

FIG. 4 is a perspective, see-through view showing a configuration of the antenna cell 1 taken along the line V-V of FIG. 3. FIG. 4 shows only the tube walls of the tube structure which is viewed through the conductive material that covers the tube structure in order to explain the structures of the polarization wave separation/combination portion and the waveguide portion connected to the antenna cell 1. FIG. 5 is a perspective cross-sectional view of the antenna cell 1 taken along the line V-V of FIG. 3. For the sake of simplification of the drawings, the horn antenna portion 2 is not shown in FIGS. 4 and 5.

As shown in FIGS. 4 and 5, the polarization wave separation/combination portion 3 is provided in such a way that its area becomes smaller in a stepwise manner as it extends downward (Z(−) side). An opening 3*a* is provided on a surface of the polarization wave separation/combination portion 3 that is vertical to the X direction. An opening 3*b* is provided on a bottom surface (Z(−) side end part) of the polarization wave separation/combination portion 3.

The polarization multiplexed signal that has been propagated from the horn antenna portion 2 to the polarization wave separation/combination portion 3 is, as will be described later, separated into the vertical polarization wave WV and the horizontal polarization wave WH in the polarization wave separation/combination portion 3.

The opening 3*a* on the side surface of the polarization wave separation/combination portion 3 of each of the antenna cells 1 is connected to a waveguide portion 4 (this waveguide portion 4 is also referred to as a first waveguide part). At the time of reception, the vertical polarization waves WV are propagated to the waveguide portion 4 from the polarization wave separation/combination portions 3 of the respective antenna cells 1 via the openings 3*a*. In the following description, the polarization wave having an electric field that is propagating through the waveguide and is vibrated in one direction is referred to as a radio wave or an electromagnetic wave having an electric field that is vibrated in one direction. The waveguide portion 4 converts and combines the vertical polarization waves WV that have been propagated into a polarization wave having an electric field that is vibrated in a Z direction (this direction will also be referred to as a first direction) (hereinafter this polarization wave is referred to as a Z polarization wave WZ or a first radio wave) and outputs the combined Z polarization wave WZ to outside (e.g., a transceiver). At the time of transmission, the Z polarization wave WZ is input to the waveguide portion 4 from outside (e.g., the transceiver). The waveguide portion 4 converts the Z polarization wave WZ that has been input into the vertical polarization wave WV, separates the vertical polarization wave WV after the conversion, and guides the separated waves to the polarization wave separation/combination portion 3 of the respective antenna cells 1.

The opening 3*b* on the bottom surface of the polarization wave separation/combination portion 3 of each of the antenna cells 1 is connected to a waveguide portion 5 (it is also referred to as a second waveguide part). At the time of reception, the horizontal polarization waves WH are input to the waveguide portion 5 from the polarization wave separation/combination portions 3 of the respective antenna cells 1 via the openings 3*b*. The horizontal polarization waves WH are converted into the Z polarization waves WZ when the propagation direction is changed at the connection portion between the polarization wave separation/combination portion 3 and the waveguide portion 5. The waveguide portion 5 combines the Z polarization waves WZ after the conversion and outputs the combined Z polarization wave WZ to outside (e.g., the transceiver). At the time of transmission, the Z polarization wave WZ is input to the waveguide portion 5 from outside (e.g., a transmitter). The waveguide portion 5 separates the Z polarization wave WZ that has been input and guides the separated waves to the polarization wave separation/combination portions 3 of the respective antenna cells 1. The Z polarization wave WZ is converted into the horizontal polarization wave when the propagation direction is changed at the connection portion between the polarization wave separation/combination portion 3 and the waveguide portion 5.

Figure 6:
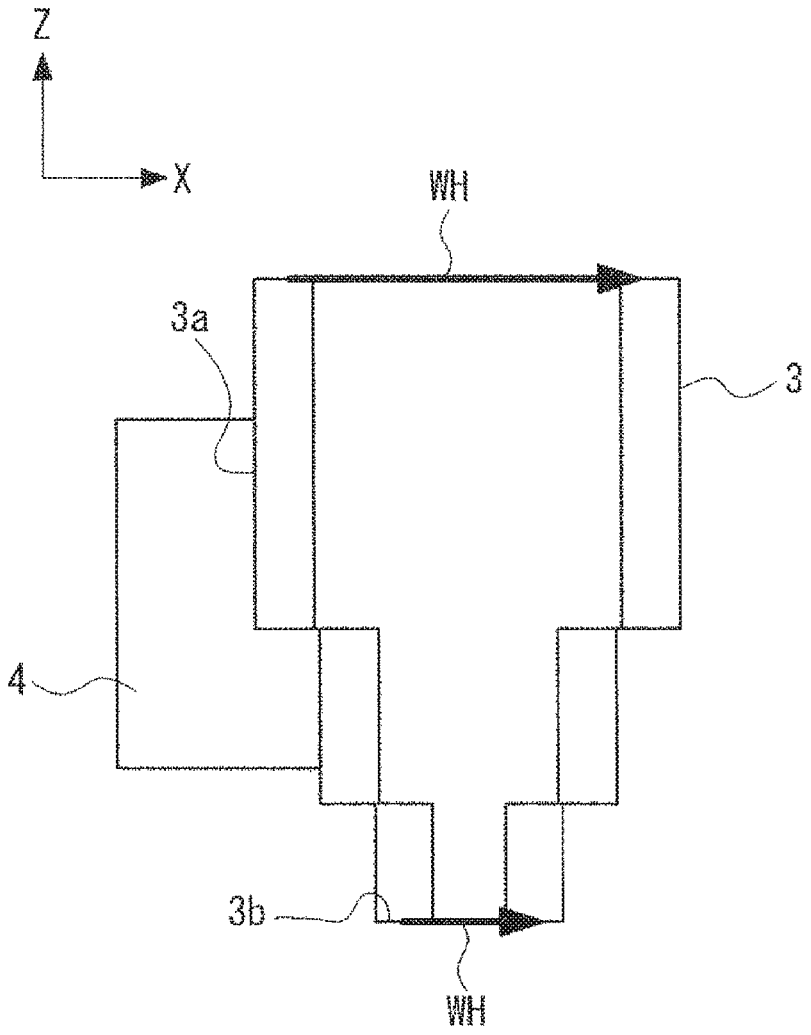
FIG. 6 is a side view of a polarization wave separation/combination portion 3 showing horizontal polarization waves WH in the polarization wave separation/combination portion 3.
Figure 7:
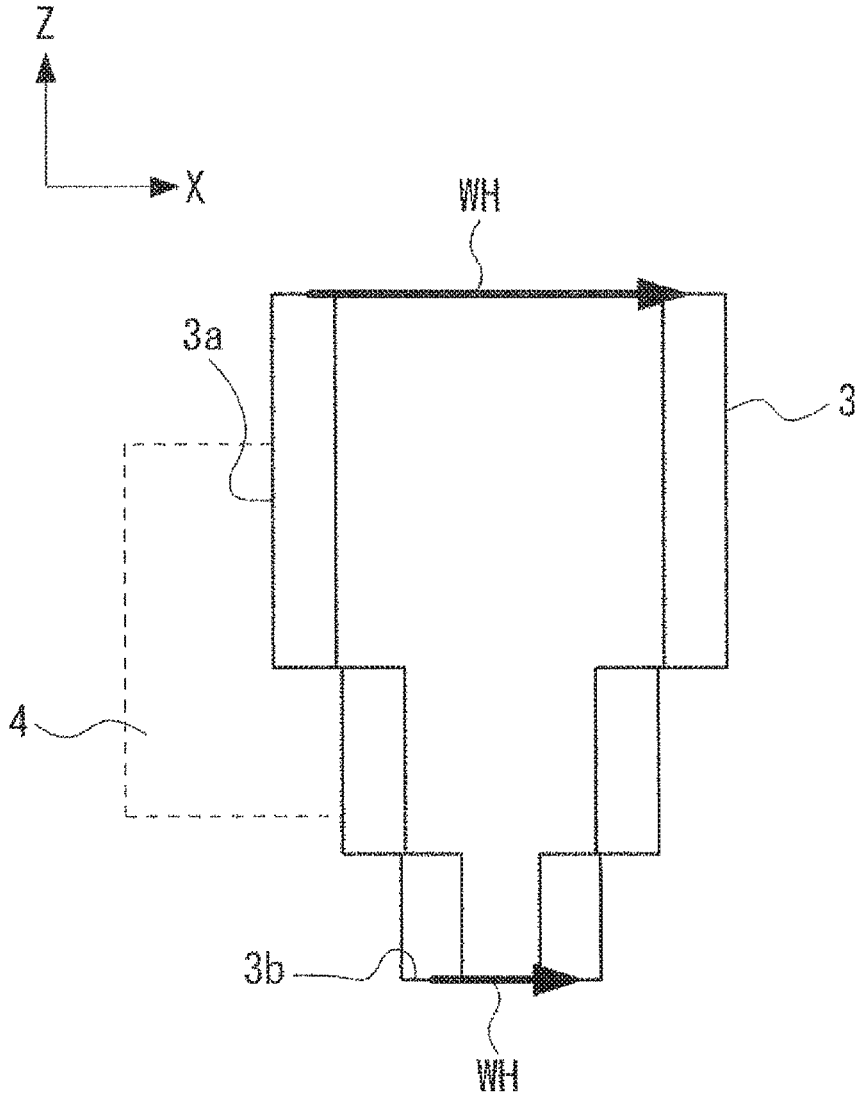
FIG. 7 is a side view showing a part of the polarization wave separation/combination portion 3 that substantially affects the horizontal polarization waves WH.

FIG. 6 is a side view of the polarization wave separation/combination portion 3 showing the horizontal polarization waves WH in the polarization wave separation/combination portion 3. As shown in FIG. 6, the horizontal polarization waves WH are polarization waves whose electric fields are vibrated in the X direction. In this case, since the waveguide portion 4 connected to the opening 3*a* on the side surface serves as a cutoff waveguide with respect to the horizontal polarization waves WH, it can be regarded that the waveguide portion 4 is electrically short-circuited. FIG. 7 is a side view showing a part of the polarization wave separation/combination portion 3 that substantially affects the horizontal polarization waves WH. As shown in FIG. 7, it can be regarded that the opening 3*a* and the waveguide portion 4 do not exist for the horizontal polarization waves WH.

Figure 8:
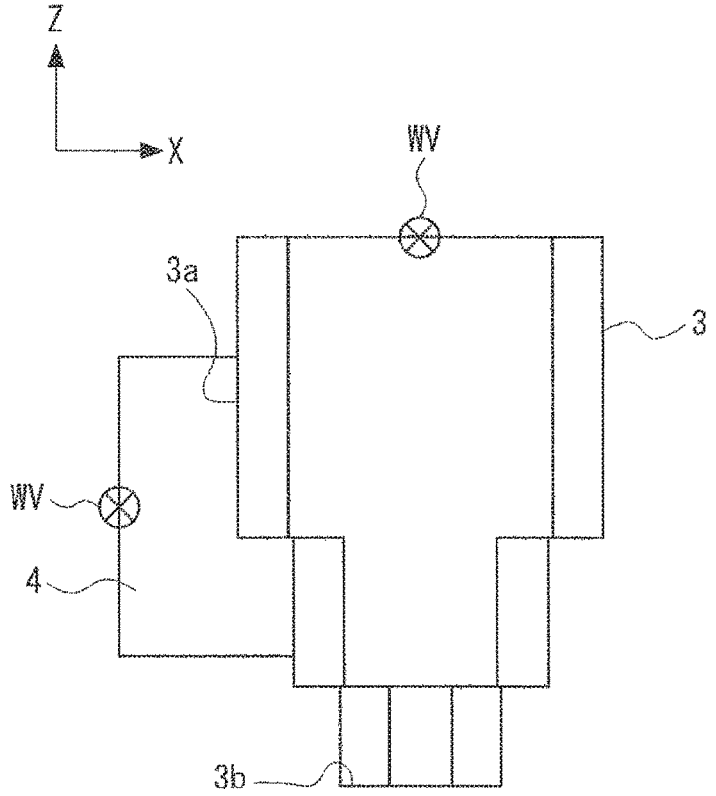
FIG. 8 is a side view of the polarization wave separation/combination portion 3 showing vertical polarization waves WV in the polarization wave separation/combination portion 3.
Figure 9:
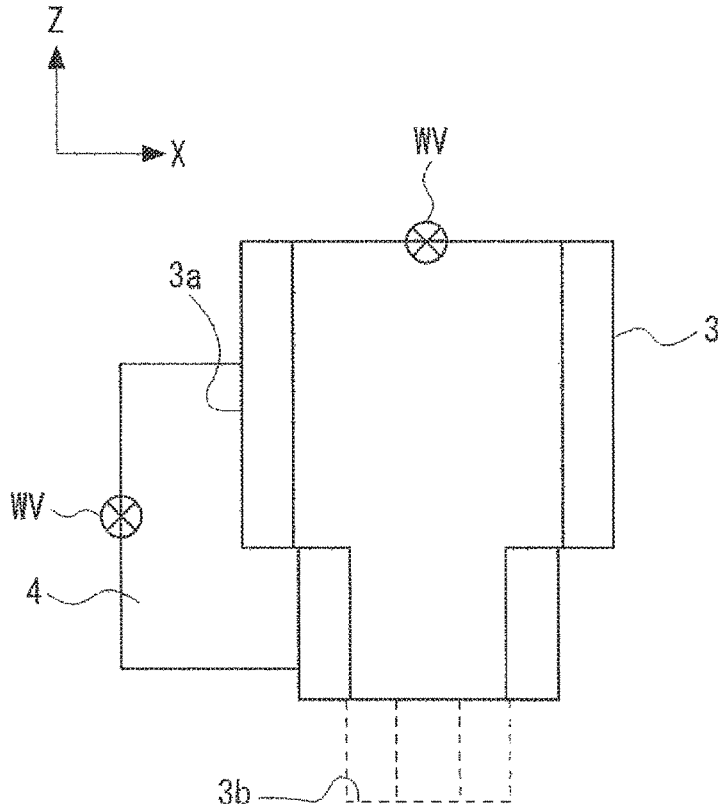
FIG. 9 is a side view showing a part of the polarization wave separation/combination portion 3 that substantially affects the vertical polarization waves WV.

FIG. 8 is a side view of the polarization wave separation/combination portion 3 showing the vertical polarization waves WV in the polarization wave separation/combination portion 3. As shown in FIG. 8, the vertical polarization waves WV are polarization waves whose electric fields are vibrated in the Y direction. In this case, since the waveguide portion 5 connected to the opening 3*b* on the bottom surface serves as a cutoff waveguide with respect to the vertical polarization waves WV, it can be regarded that the waveguide portion 5 is electrically short-circuited. FIG. 9 is a side view showing a part of the polarization wave separation/combination portion 3 that substantially affects the vertical polarization waves WV. As shown in FIG. 8, it can be regarded that the area from the lower part of the polarization wave separation/combination portion 3 to the opening 3*b* and the waveguide portion 5 do not exist for the vertical polarization waves WV.

From the aforementioned description, it will be understood that the horizontal polarization waves WH propagate from the polarization wave separation/combination portion 3 to the waveguide portion 5 via the opening 3*b* and the vertical polarization waves WV propagate from the polarization wave separation/combination portion 3 to the waveguide portion 4 via the opening 3*a*.

Figure 10:
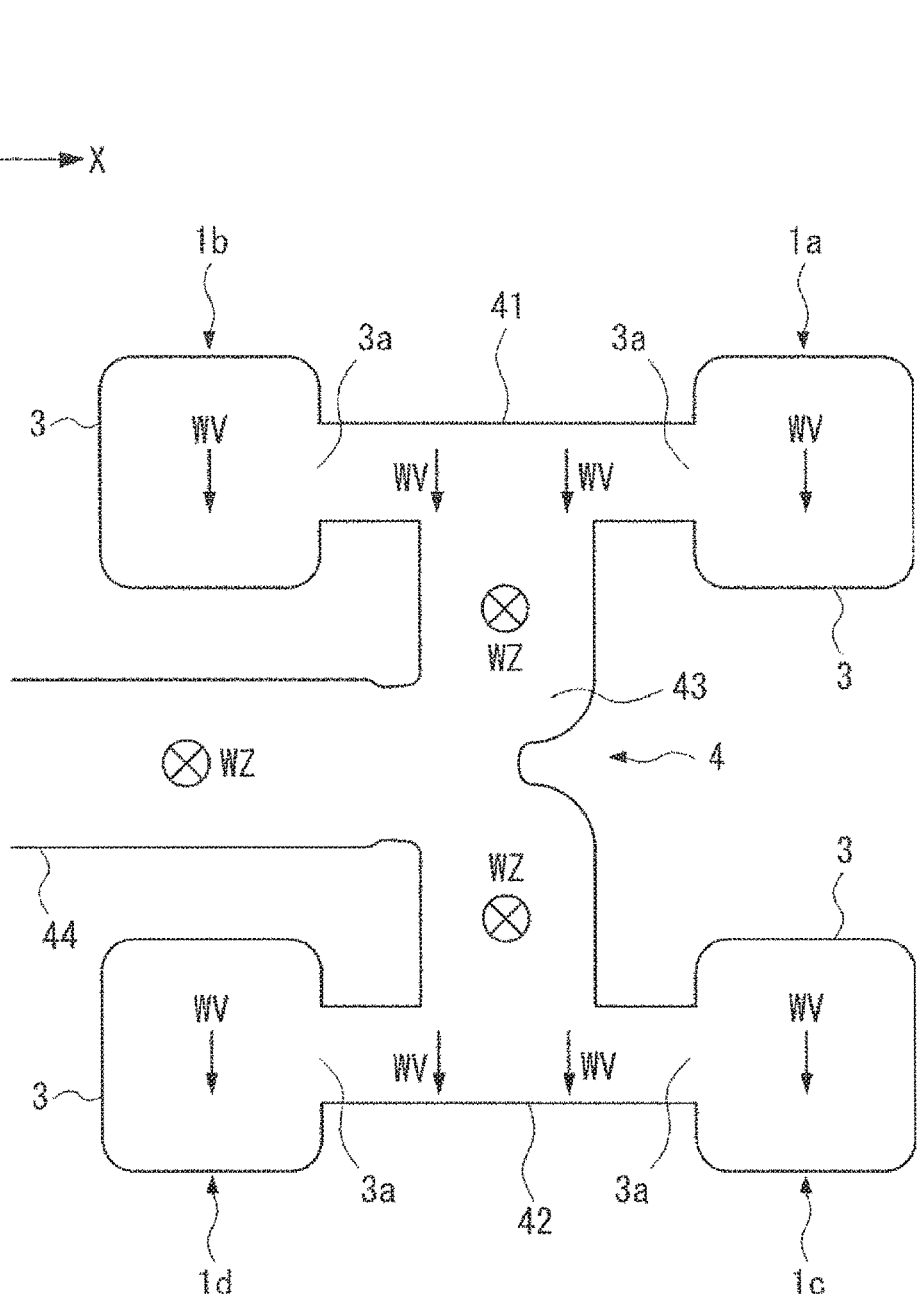
FIG. 10 is a diagram showing the vertical polarization waves guided by a waveguide portion 4 in the antenna 10.

Next, exemplary aspects of wave guiding of the vertical polarization waves WV and the horizontal polarization waves WH in the antenna 10 will be described. FIG. 10 is a diagram showing the vertical polarization waves WV guided by the waveguide portion 4 in the antenna 10. In FIG. 10, antenna cells 1*a* to 1*d* (the antenna cells 1*a* to 1*d* are also referred to as first to fourth antenna elements, respectively) are provided in the antenna 10. The antenna cell 1*a* corresponds to the aforementioned antenna cell 1. The antenna cell 1*b* is line symmetric to the antenna cell 1*a* with respect to the Y axis. The antenna cell 1*c* is line symmetric to the antenna cell 1*a* with respect to the X axis. The antenna cell 1*d* is line symmetric to the antenna cell 1*b* with respect to the axis.

The opening 3*a* of the antenna cell 1*a* and the opening 3*a* of the antenna cell 1*b* are opposed to each other with respect to the Y axis and are coupled to each other by a waveguide 41 (it may also be referred to as a third waveguide) that guides the polarization waves in the X direction. The opening 3*a* of the antenna cell 1*c* and the opening 3*a* of the antenna cell 1*d* are opposed to each other with respect to the Y axis and are coupled to each other by a waveguide 42 (it may also be referred to as a fourth waveguide) that guides the polarization waves in the X direction. The center of the waveguide 41 and the center of the waveguide 42 are coupled to each other by an electric field direction conversion portion 43 that guides the polarization waves in the Y direction. The center of the electric field direction conversion portion 43 is connected to the waveguide 44 that guides the polarization waves in the X direction.

First, wave guiding at the time of reception will be described. The vertical polarization wave WV included in the polarization multiplexed signal that has been propagated to the antenna cell 1*a* propagates to one end of the waveguide 41. The vertical polarization wave WV included in the polarization multiplexed signal that has been propagated to the antenna cell 1*b* propagates to the other end of the waveguide 41. The waveguide 41 is formed in such a way that the distance from the center of the waveguide 41 to the opening 3*a* of the antenna cell 1*a* becomes equal to the distance from the center of the waveguide 41 to the opening 3*a* of the antenna cell 1*b*. Accordingly, the vertical polarization waves WV that are propagated from the respective ends of the waveguide 41 are combined in the same phase at the center of the waveguide 41.

The vertical polarization wave WV included in the polarization multiplexed signal that has been propagated to the antenna cell 1*c* propagates to one end of the waveguide 42. The vertical polarization wave WV included in the polarization multiplexed signal that has been propagated to the antenna cell 1*d* propagates to the other end of the waveguide 42. The waveguide 42 is provided in such a way that the distance from the center of the waveguide 42 to the opening 3*a* of the antenna cell 1*c* becomes equal to the distance from the center of the waveguide 42 to the opening 3*a* of the antenna cell 1*d*. Accordingly, the vertical polarization waves WV that are propagated from the respective ends of the waveguide 42 are combined in the same phase at the center of the waveguide 42.

The electric field direction conversion portion 43 converts the vertical polarization waves WV that are propagated to the respective ends into the Z polarization waves WZ whose vibration direction of the electric field (i.e., a polarization plane) is the Z direction and combines the Z polarization waves WZ after the conversion at the center of the electric field direction conversion portion 43. In other words, the electric field direction conversion portion 43 rotates the vibration direction of the electric field of the vertical polarization wave WV having an electric field that is vibrated in the Y direction to convert the vertical polarization wave WV into the Z polarization wave WZ having an electric field that is vibrated in the Z direction. The combined Z polarization wave WZ is output to outside (e.g., the transceiver) via the waveguide 44.

Figure 11:
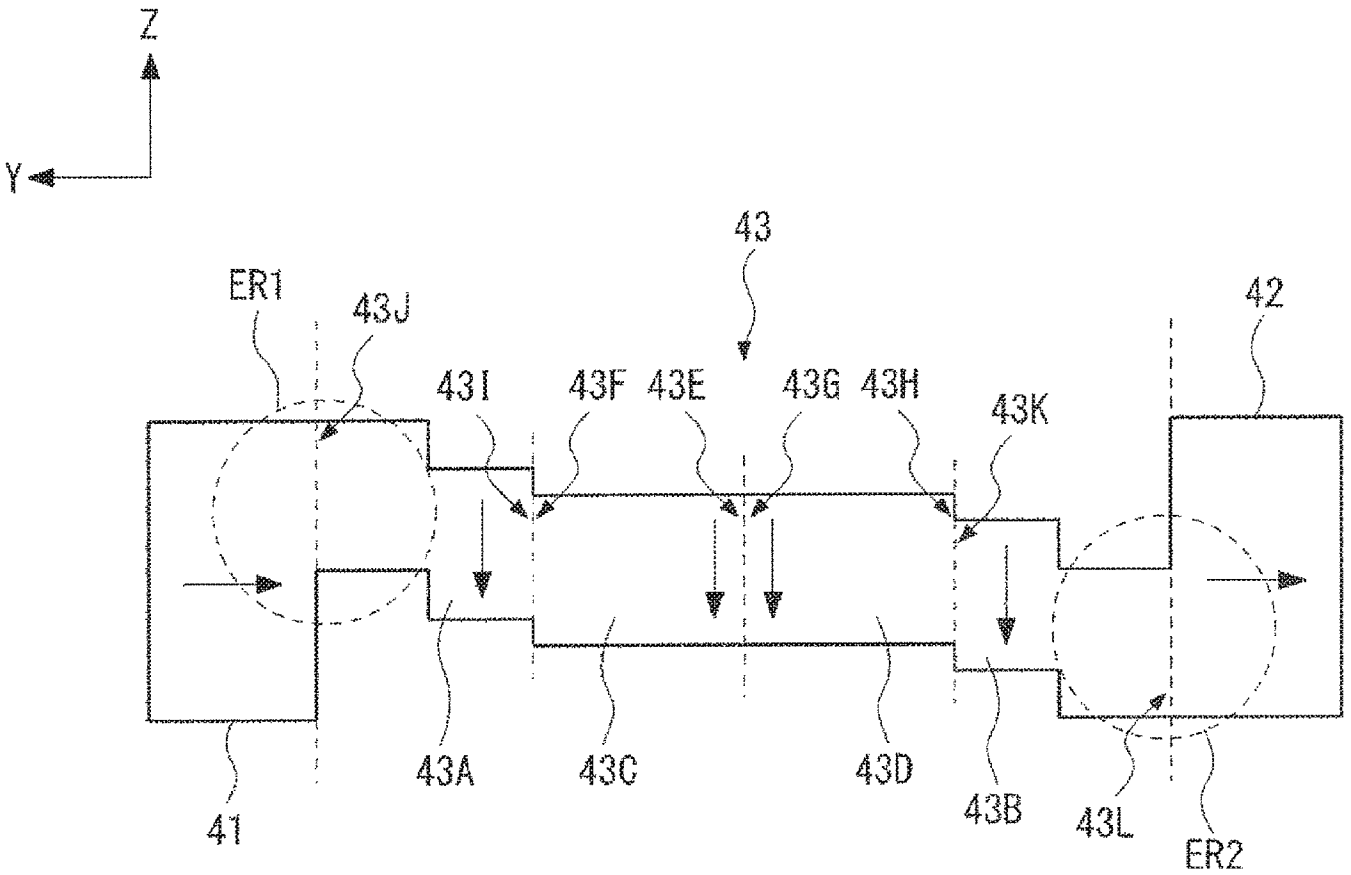
FIG. 11 is a cross-sectional view of an electric field direction conversion portion 43 on a Y-Z plane.

FIG. 11 is a cross-sectional view of the electric field direction conversion portion 43 on the Y-Z plane. The electric field direction conversion portion 43 has a Y(+) side end connected to the upper central part of the waveguide 41 and a Y(−) side end connected to the lower central part of the waveguide 42.

The electric field direction conversion portion 43 includes a waveguide shift portion 43A (a first waveguide shift portion), a waveguide shift portion 43B (also called a second waveguide shift portion), a waveguide 43C, and a waveguide 43D. The waveguide 43C and the waveguide 43D are extended in the Y direction and are cascade connected to each other. A Y(−) side end part 43E (a first end part) of the waveguide 43C is connected to a Y(+) side end part 43G (a third end part) of the waveguide 43D.

The waveguide shift portion 43A has a Y(−) side end part 43I (a fifth end part) connected to a Y(+) side end part 43F (a second end part) of the waveguide 43C and a Y(+) side end part 43J (a sixth end part) connected to the center of the waveguide 41. The waveguide shift portion 43A is a waveguide having a step-like shape in which its height in the Z direction becomes lower by two stages from the Y(+) side end part 43J (the sixth end part) toward the Y(−) side end part 43I (the fifth end part).

The waveguide shift portion 43B has a Y(+) side end part 43K (a seventh end part) connected to a Y(−) side end part 43H (a fourth end part) of the waveguide 43D and a Y(−) side end part 43L (an eighth end part) connected to the center of the waveguide 42. The waveguide shift portion 43B is a waveguide having a step-like shape in which its height in the Z direction becomes higher by two stages from the Y(−) side end part 43L (the eighth end part) toward the Y(+) side end part 43K (the seventh end part).

The connection portion between the waveguide 43C and the waveguide 43D (the connection portion between the Y(−) side end part 43E (the first end part) of the waveguide 43C and the Y(+) side end part 43G (the third end part) of the waveguide 43D) serves as an input and output end that mediates the polarization waves input to the electric field direction conversion portion 43 and the polarization waves output from the electric field direction conversion portion 43.

With reference to FIG. 11, the electric field direction conversion in the electric field direction conversion portion 43 at the time of reception will be described. In FIG. 11, the phase of the vertical polarization wave at the center of the waveguide 41 becomes equal to the phase of the vertical polarization wave at the center of the waveguide 42. It is assumed here that the amplitude of the vertical polarization wave at the center of the waveguide 41 and that of the waveguide 42 are the Y(−) side.

The polarization plane (that is, the vibration direction of the electric field is the Y direction) of the vertical polarization wave on the Y(+) side of the electric field direction conversion portion 43 is rotated clockwise (right rotation) by 90° about the X axis in an electric field direction rotation portion ER1 shown in FIG. 11 while the vertical polarization wave on the Y(+) side of the electric field direction conversion portion 43 is propagated to the center of the electric field direction conversion portion 43 via the waveguide shift portion 43A and thus the vertical polarization wave on the Y(+) side of the electric field direction conversion portion 43 is converted to the Z polarization wave WZ.

The polarization plane (that is, the vibration direction of the electric field is the Y direction) of the vertical polarization wave on the Y(−) side of the electric field direction conversion portion 43 is rotated clockwise (right rotation) by 90° about the X axis in an electric field direction rotation portion ER2 shown in FIG. 11 while the vertical polarization wave on the Y(−) side of the electric field direction conversion portion 43 is propagated to the center of the electric field direction conversion portion 43 via the waveguide shift portion 43B and thus the vertical polarization wave on the Y(−) side of the electric field direction conversion portion 43 is converted to the Z polarization wave WZ.

Next, wave guiding at the time of transmission will be described. The Z polarization wave WZ from outside (e.g., the transceiver) is propagated to the electric field direction conversion portion 43 via the waveguide 44. The electric field direction conversion portion 43 separates and converts the Z polarization wave WZ that has been propagated into the vertical polarization waves WV that are in phase with each other and guides the vertical polarization waves WV to the center of the waveguide 41 and the center of the waveguide 42.

With reference to FIG. 11, the electric field direction conversion in the electric field direction conversion portion 43 at the time of transmission will be described. The Z polarization wave WZ that has been propagated from the waveguide 44 to the center of the electric field direction conversion portion 43 is separated into two polarization waves. The polarization plane of one of the Z polarization waves WZ after the separation is rotated counterclockwise (left rotation) by 90° about the X axis while it propagates to the center of the waveguide 41 via the waveguide shift portion 43A and one of the Z polarization waves WZ is converted to the vertical polarization wave WV. The polarization plane of the other one of the Z polarization waves WZ after the separation is rotated counterclockwise (left rotation) by 90° about the X axis while it propagates to the center of the waveguide 42 via the waveguide shift portion 43B and thus the other one of the Z polarization waves WZ is converted to the vertical polarization wave WV. As described above, since the polarization planes of the two Z polarization waves WZ after the separation are rotated in the same direction, the phase of the vertical polarization wave WV at the center of the waveguide 41 becomes equal to the phase of the vertical polarization wave WV at the center of the waveguide 42.

The waveguide 41 separates the vertical polarization wave WV that has been propagated and guides the separated waves to the respective antenna cells 1*a* and 1*b*. The waveguide 42 separates the vertical polarization wave WV that has been propagated and guides the separated waves to the respective antenna cells 1*c* and 1*d*.

Figure 12:
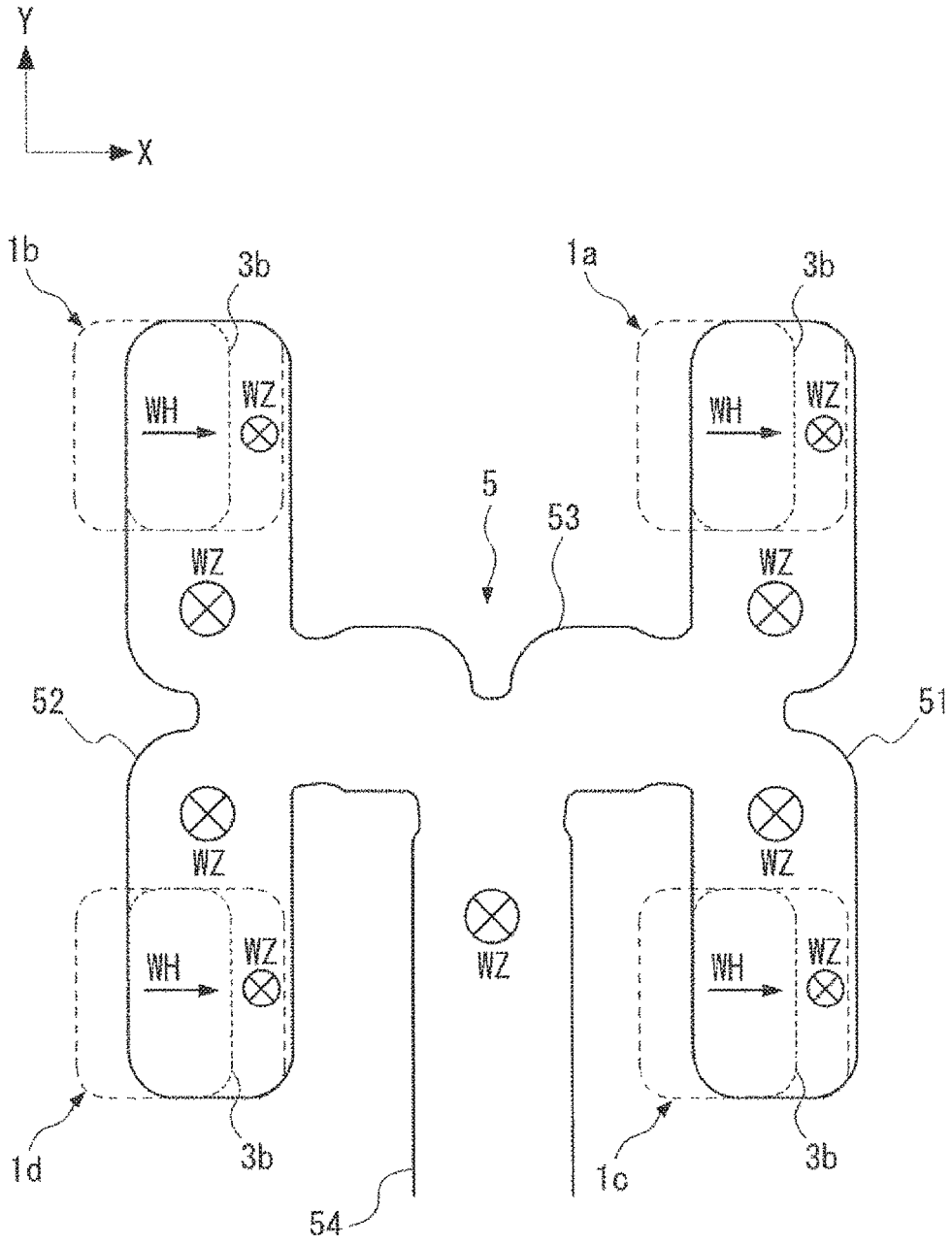
FIG. 12 is a diagram showing the horizontal polarization waves guided by a waveguide portion 5 in the antenna 10.

FIG. 12 is a diagram showing the horizontal polarization waves guided by the waveguide portion 5 in the antenna 10. The opening 3*b* of the antenna cell 1*a* and the opening 3*b* of the antenna cell 1*c* are opposed to each other with respect to the X axis and are coupled to each other by a waveguide 51 that guides the polarization waves in the Y direction. The opening 3*b* of the antenna cell 1*b* and the opening 3*b* of the antenna cell 1*d* are opposed to each other with respect to the X axis and are coupled to each other by a waveguide 52 that guides the polarization waves in the Y direction. The center of the waveguide 51 and the center of the waveguide 52 are coupled to each other by a waveguide 53 that guides the polarization waves in the X direction. A waveguide 54 that guides the polarization waves in the Y direction is connected to the center of the waveguide 53.

First, wave guiding at the time of reception will be described. The horizontal polarization wave WH included in the polarization multiplexed signal that has been propagated to the antenna cell 1*a* propagates to the opening 3*b* of the polarization wave separation/combination portion 3 of the antenna cell 1*a*. Then the vibration direction of the electric field (that is, the polarization plane) of the horizontal polarization wave WH is rotated by 90° about the Y axis while the horizontal polarization wave WH propagates from the opening 3*b* to the waveguide 51 and thus the horizontal polarization wave WH becomes the Z polarization wave WZ. The horizontal polarization wave WH included in the polarization multiplexed signal that has been propagated to the antenna cell 1*c* propagates to the opening 3*b* of the polarization wave separation/combination portion 3 of the antenna cell 1*c*. After that, the vibration direction of the electric field (that is, the polarization plane) of the horizontal polarization wave WH is rotated by 90° about the Y axis while the horizontal polarization wave WH propagates from the opening 3*b* to the waveguide 51 and thus the horizontal polarization wave WH becomes the Z polarization wave WZ. The waveguide 51 is provided in such a way that the distance from the center of the waveguide 51 to the opening 3*b* of the antenna cell 1*a* becomes equal to the distance from the center of the waveguide 51 to the opening 3*b* of the antenna cell 1*c*. Accordingly, the Z polarization waves WZ that propagate from the respective ends of the waveguide 51 are combined in the same phase at the center of the waveguide 51.

The horizontal polarization wave WH included in the polarization multiplexed signal that has been propagated to the antenna cell 1*b* propagates to the opening 3*b* of the polarization wave separation/combination portion 3 of the antenna cell 1*b*. After that, the vibration direction of the electric field (that is, the polarization plane) of the horizontal polarization wave WH is rotated by 90° about the Y axis while the horizontal polarization wave WH propagates from the opening 3*b* to the waveguide 52 and thus the horizontal polarization wave WH becomes the Z polarization wave WZ. The horizontal polarization wave WH included in the polarization multiplexed signal that has been propagated to the antenna cell 1*d* propagates to the opening 3*b* of the polarization wave separation/combination portion 3 of the antenna cell 1*d*. After that, the vibration direction of the electric field (that is, the polarization plane) of the horizontal polarization wave WH is rotated by 90° about the Y axis while the horizontal polarization wave WH propagates from the opening 3*b* to the waveguide 52 and the horizontal polarization wave WH becomes the Z polarization wave WZ. The waveguide 52 is provided in such a way that the distance from the center of the waveguide 52 to the opening 3*b* of the antenna cell 1*b* becomes equal to the distance from the center of the waveguide 52 to the opening 3*b* of the antenna cell 1*d*. Accordingly, the Z polarization waves WZ that propagate from the respective ends of the waveguide 52 are combined in the same phase at the center of the waveguide 52.

The waveguide 52 is provided in such a way that the distance from the center of the waveguide 53 to the center of the waveguide 51 becomes equal to the distance from the center of the waveguide 52 to the center of the waveguide 51. Accordingly, the Z polarization waves WZ that are propagated from the respective ends of the waveguide 53 are combined in the same phase at the center of the waveguide 53. The combined Z polarization wave WZ is output to outside (e.g., the transceiver) via the waveguide 54.

Next, wave guiding at the time of transmission will be described. The Z polarization wave WZ is propagated from outside (e.g., the transceiver) to the center of the waveguide 51 and the center of the waveguide 52 via the waveguides 54 and 53. The waveguide 51 separates the Z polarization wave WZ that has been propagated. The Z polarization waves WZ after the separation are propagated to the respective openings 3*b* of the antenna cells 1*a* and 1*c*. After that, the vibration direction of the electric field (i.e., the polarization plane) of the Z polarization waves WZ is rotated by 90° about the Y axis while the Z polarization waves WZ propagate from the waveguide 51 to the openings 3*b* and thus the Z polarization waves WZ become the horizontal polarization waves WH. The waveguide 52 separates the Z polarization wave WZ that has been propagated. The Z polarization waves WZ after the separation are propagated to the respective openings 3*b* of the antenna cells 1*b* and 1*d*. After that, the vibration direction of the electric field (that is, the polarization plane) of the Z polarization waves WZ is rotated by 90° about the Y axis while the Z polarization waves WZ propagate from the waveguide 52 to the openings 3*b* and thus the Z polarization waves WZ become the horizontal polarization waves WH.

As described above, the bending portion is present in the connection portion between the opening 3*b* on the bottom surface of the polarization wave separation/combination portion 3 and the waveguide portion 5. According to this structure, the propagation direction of the horizontal polarization wave WH and that of the Z polarization wave WZ are changed, with the direction perpendicular to the polarization plane serving as a rotation axis, whereby the polarization plane of the horizontal polarization wave WH and that of the Z polarization wave WZ are rotated by 90°. As a result, the electric field direction conversion can be mutually performed between the horizontal polarization wave WH and the Z polarization wave WZ.

In a similar way, regarding the vertical polarization wave WV as well, it may be possible to perform the electric field direction conversion between the vertical polarization wave WV and the Z polarization wave WZ by connecting the polarization wave separation/combination portion 3 and the waveguide portion through the opening provided on the bottom surface of the polarization wave separation/combination portion 3. In this case, however, the two different waveguide portions need to be arranged in the same layer. When the structure in which the polarization waves that have been guided are combined in phase with each other is provided in the state in which the two different waveguide portions are arranged in the same layer, it becomes difficult to arrange the waveguides of the respective waveguide portions in such a way that they do not interfere with one another. Further, when the waveguides are arranged in such a way that they do not interfere with one another, the structure becomes complicated, which causes an increase in the number of manufacturing processes and an increase in the thickness of the planar antenna.

On the other hand, in this exemplary embodiment, the waveguide portion 4 through which the vertical polarization waves pass has the electric field direction conversion function (the electric field direction conversion portion 43), whereby the waveguide portion that receives or outputs the vertical polarization waves and the waveguide portion that receives or outputs the horizontal polarization waves can be arranged in layers different from each other. Further, the introduction of the electric field direction conversion portion prevents an increase in the thickness of the waveguide layer including the electric field direction conversion portion. It is therefore possible to provide a high-gain and thin polarized wave shared planar antenna that uses the waveguides.

Other Exemplary Embodiments

Note that the present invention is not limited to the aforementioned exemplary embodiments and may be changed as appropriate without departing from the spirit of the present invention. For example, while the aforementioned horn antenna portion 2 includes the rectangular opening, this is merely an example. A horn antenna portion having an opening whose shape is other than the rectangular shape (e.g., circular shape) may be employed. Further, the horn antenna structure may be replaced by, for example, a slot structure such as a cross-shaped slot.

Needless to say, the number of antennas 10 and the number of antenna cells 1 stated above are merely examples and the number of components in the planar antenna may be increased or decreased as appropriate.

Although the present invention has been described above with reference to exemplary embodiments, the present invention is not limited to the above exemplary embodiments. The configuration and details of the present invention can be modified in various manners which can be understood by those skilled in the art within the scope of the invention.

This application is based upon and claims the benefit of priority from Japanese Patent Application No. 2014-166007, filed on Aug. 18, 2014, the disclosure of which is incorporated herein in its entirety by reference.

REFERENCE SIGNS LIST

1, 1*a*-1*d* ANTENNA CELL
2 HORN ANTENNA PORTION
3 POLARIZATION WAVE SEPARATION/COMBINATION PORTION
3*a*, 3*b* OPENING
4, 5 WAVEGUIDE PORTION
10 ANTENNA
41, 42, 43C, 43D, 44, 51-54 WAVEGUIDE
43 ELECTRIC FIELD DIRECTION CONVERSION PORTION
43A, 43B WAVEGUIDE SHIFT PORTION
100 PLANAR ANTENNA
WH HORIZONTAL POLARIZATION WAVE
WV VERTICAL POLARIZATION WAVE

The invention claimed is:

1. A planar antenna comprising:

first to fourth antenna elements that are arranged in a grid on a plane that is vertical to a first direction, each of the first to fourth antenna elements combining a plurality of polarization waves and transmitting a polarization multiplexed signal or separating a polarization multiplexed signal that has been received into a plurality of polarization waves;

a first waveguide part configured to output a second radio wave to the first to fourth antenna elements or receives the second radio wave that has been separated by the first to fourth antenna elements; and a second waveguide part configured to output a third radio wave having an electric field whose vibration direction is vertical to the vibration direction of the electric field of the second radio wave to the first to fourth antenna elements or receives the third radio wave separated by the first to fourth antenna elements, wherein the first waveguide part comprises:

an electric field direction conversion structure comprising:

a first waveguide configured to guide a first radio wave whose electric field is vibrated in the first direction along a second direction that is vertical to the first direction between a first end part and a second end part;

a second waveguide configured to guide the first radio wave along the second direction between a third end part and a fourth end part, the second waveguide being cascade connected to the first waveguide by a connection of the first end part and the third end part;

an input and output end configured to multiplex the first radio wave from the first waveguide and the first radio wave from the second waveguide and outputs the multiplexed radio wave, and outputs the first radio wave branched off from a radio wave from outside to the first and second waveguides at a connection portion between the first end part and the third end part;

a first waveguide shift portion having a fifth end part connected to the second end part of the first waveguide and a sixth end part that is shifted from the fifth end part in the first direction, the second radio wave having an electric field vibrated in the second direction being input or output to or from the sixth end part along the second direction; and a second waveguide shift portion having a seventh end part connected to the fourth end part of the second waveguide and an eighth end part that is shifted from the seventh end part in the first direction and in a direction opposite to the sixth end part, the second radio wave having an electric field vibrated in the second direction being input or output to or from the eighth end part along the second direction;

a third waveguide having one end connected to the first antenna element and another end connected to the second antenna element, the center of the third waveguide being connected to the sixth end part, and the third waveguide extending in a third direction that is vertical to the first and second directions; and a fourth waveguide having one end connected to the third antenna element and another end connected to the fourth antenna element, the center of the fourth waveguide being connected to the eighth end part, and the fourth waveguide extending in the third direction, a vibration direction of an electric field of a radio wave passing through the sixth end part of the first waveguide shift portion is rotated by 90° about the third direction, a vibration direction of an electric field of a radio wave passing through the eighth end part of the second waveguide shift portion is rotated by 90° about the third direction in a direction the same as the rotational direction in the sixth end part, the vibration direction of the electric field of the third radio wave is vertical to the vibration direction of the electric field of the first radio wave, the first waveguide shift portion is formed of a curved waveguide that connects the fifth end part and the sixth end part, and the second waveguide shift portion is formed of a curved waveguide that connects the seventh end part and the eighth end part.

2. The planar antenna according to claim 1, wherein the center axis of the waveguide that constitutes the first waveguide shift portion and the second waveguide shift portion is the second direction, and the waveguide has a step-like shape and is shifted in a step-like manner along the first direction.

3. The planar antenna according to claim 1, wherein the distance between the input and output end and the sixth end part is equal to the distance between the input and output end and the eighth end part.

4. The planar antenna according to claim 1, wherein the distance between the center of the third waveguide and the first antenna element, the distance between the center of the third waveguide and the second antenna element, the distance between the center of the fourth waveguide and the third antenna element, and the distance between the center of the fourth waveguide and the fourth antenna element are equal to one another.

5. The planar antenna according to claim 1, wherein the first to fourth antenna elements each comprise:

a polarization wave separation/combination portion configured to separate the second radio wave and the third radio wave included in the polarization multiplexed signal or combines the second radio wave and the third radio wave into the polarization multiplexed signal;

a horn antenna portion configured to transmit the polarization multiplexed signal from the polarization wave separation/combination portion or transmits the polarization multiplexed signal that has been received to the polarization wave separation/combination portion, and the polarization wave separation/combination portion receives or outputs the second radio wave through an opening on a plane vertical to the third direction and receives or outputs the third radio wave through an opening on a bottom surface vertical to the first direction.

6. The planar antenna according to claim 5, wherein the second waveguide part is connected to the opening on the bottom surface of the polarization wave separation/combination portion of each of the first to fourth antenna elements, and the second waveguide part converts the third radio wave from the opening on the bottom surface of the polarization wave separation/combination portion of each of the first to fourth antenna elements into the first radio wave, combines the resulting radio waves in phase with each other, and outputs the combined radio wave or separates the first radio wave input from outside to convert the first radio wave into the third radio wave and guides the third radio wave after the conversion to the opening on the bottom surface of the polarization wave separation/combination portion of each of the first to fourth antenna elements in the same phase.

7. The planar antenna according to claim 1, wherein the first waveguide part and the second waveguide part are formed in different layers laminated to each other in the first direction.

8. A planar antenna comprising:

a plurality of antenna elements arranged on a first plane;

a first waveguide part configured to receive or outputs a first radio wave from or to the plurality of antenna elements, the first radio wave being used for orthogonal polarization transmission; and a second waveguide part configured to receive or outputs a second radio wave whose polarization plane is perpendicular to the polarization plane of the first radio wave from or to the plurality of antenna elements, wherein the first waveguide part and the second waveguide part are laminated to each other substantially parallel to the first plane, the first waveguide part comprises an electric field direction conversion portion having a first end part connected to a first antenna element, a second end part connected to a second antenna element, and an input and output end through which a third radio wave having a polarization plane perpendicular to the polarization plane of the first radio wave is input or output, the polarization plane of the third radio wave is rotated in such a way that the polarization plane of the third radio wave matches the polarization plane of the first radio wave while the third radio wave is guided from the input and output end to the first and second end parts, and the polarization plane of the first radio wave is rotated in such a way that the polarization plane of the first radio wave matches the polarization plane of the third radio wave while the first radio wave is guided from the first and second end parts to the input and output end.

9. The planar antenna according to claim 8, wherein the electric field direction conversion portion is a waveguide that couples the first end part and the second end part, and the input and output end is provided at the center of the waveguide that is provided between the first end part and the second end part.

* * * * *